United States Patent [19]

Rodth

[11] 4,291,546

[45] Sep. 29, 1981

[54] COLD PLATE HEAT EXCHANGER

[75] Inventor: Joseph J. Rodth, Pleasant Valley, Conn.

[73] Assignee: Alco Foodservice Equipment Company, Miami, Fla.

[21] Appl. No.: 47,645

[22] Filed: Jun. 11, 1979

[51] Int. Cl.[3] ..... B67D 5/62; F26B 39/02

[52] U.S. Cl. ..... 62/398; 62/515; 165/163

[58] Field of Search ..... 62/399, 400, 397, 398, 62/515, 516; 165/163

[56] References Cited

U.S. PATENT DOCUMENTS

| | | | |
|---|---|---|---|
| 772,339 | 10/1904 | Condict | 165/163 |
| 812,256 | 2/1906 | Black | 62/398 |
| 943,725 | 12/1909 | Whitaker | 165/163 |
| 2,171,369 | 8/1939 | Marcus | 165/163 |
| 2,276,811 | 3/1942 | Ward | 62/515 X |
| 2,487,674 | 11/1949 | Rott | 62/515 |
| 2,607,519 | 8/1952 | Sanborn | 62/398 |

*Primary Examiner*—Lloyd L. King

*Attorney, Agent, or Firm*—Haight, Hofeldt, Davis & Jambor

[57] ABSTRACT

A heat exchanger for fluids is disclosed in the form of a cold plate of the type utilized with ice cooled beverage dispensers. The cold plate has a heat conducting casting in which are embedded conduits for various liquids to be cooled, such as various flavored syrups, sweet water and carbonated water. One of the fluid conduits, such as that for the carbonated water, is formed of two tubular members, with a third tubular member interconnecting the first two tubular members. The first two tubular members are substantially planar with a convoluted or serpentine shape. The two tubular members are positioned as two layers, with the top layer or first tubular member adjacent to the top surface of the casting against which the ice is positioned. Carbonated water or other fluid is introduced into the bottom layer, or second tubular member, and after the carbonated water has passed through this member it is conveyed to the end of the first tubular member adjacent the end of the second tubular member into which the carbonated water was initially introduced. After passing through the first tubular member, the cooled carbonated water is removed for dispensing.

13 Claims, 4 Drawing Figures

COLD PLATE HEAT EXCHANGER

BACKGROUND OF THE INVENTION

1. Field of the Invention

This invention relates generally to a heat exchanger for fluids, and more specifically, this invention relates to a cold plate heat exchanger for cooling carbonated water in a beverage dispenser.

2. Description of the Prior Art

In many locations where it is desired to dispense carbonated beverages, it is either impossible or undesirable to provide a compression-expansion refrigeration system. Examples of such locations are ball parks, circuses or carnivals, large picnic or social gatherings, and a variety of other such situations in which limited usage does not warrant the installation of a full scale mechanical refrigerating apparatus.

Carbonated beverage dispensers for such locations utilize a so-called "cold plate" heat exchanger, in which ice is located on a heat conducting medium to withdraw heat from the fluids to be cooled. The cold plate normally has tubes or coils of a suitable material, such as stainless steel, imbedded in a heat conducting casting, such as an aluminum casting. Melt water from the ice is constantly drained from the surface of the ice contacting the cold plate by a sloping depression formed in the top of the cold plate and removed by a suitable drain arrangement.

For a carbonated beverage dispenser, maximum cooling of the carbonated water is desired, since it is the major constituent of the dispensed beverage. Prior art arrangements generally use a carbonated water duct formed as a convoluted or serpentine coil located as close to the surface on which the ice is resting as is practicable. Such an arrangement has some problems. First of all, utilization of a single layer of tubing limits the amount of surface area that can be exposed to the heat exchange process. Also, the introduction of warm water close to the surface on which the ice is resting creates uneven melting of the ice and cavitation (i.e., formation of pockets or cavities so that the ice is not resting directly against the heat exchange surface). These effects limit the efficiency of the heat exchange process and can result in the dispensing of inadequately cooled beverages.

Some attempts have apparently been made to increase the cooling efficiency of the cold plate by utilizing a second layer of coiled tubing for the carbonated water. However, these prior art approaches have inserted the carbonated water to be cooled into the top layer (i.e., the layer of tubing adjacent the ice bearing surface) and then returned the carbonated water in the second layer for removal adjacent the inlet. This approach does not, of course, do anything to solve the cavitation problem. Further, by having the outlet adjacent the inlet, efficiency of the heat exchange process is reduced as a result of the cooled outlet water drawing heat from the warm inlet water.

SUMMARY OF THE INVENTION

By means of the present invention, a more effective heat exchange arrangement is achieved. This achievement is realized by the utilization of a first conduit or tubular member having a convoluted or serpentine shape and lying substantially in a plane generally parallel to a generally planar heat exchange surface. This heat exchange surface may be the surface of a cold plate casting against which the ice is placed. A second conduit or tubular member having a convoluted or serpentine shape is located substantially on a plane parallel to the heat exchange surface and is located adjacent the side of the first conduit away from the heat exchange surface.

The fluid to be cooled, such as carbonated water, is inserted into the second conduit at one end where an appropriate inlet fitting is located. An outlet fitting for removal of the cooled carbonated water, which is to be conveyed to a dispensing location, is located at one end of the first conduit. This end of the first conduit is at the opposite end from the inlet end of the second conduit. The third conduit or tubular member is provided to interconnect the end of the second conduit away from the inlet to the end of the first conduit away from the outlet. This end of the first conduit is adjacent to the inlet end of the second conduit.

In the cold plate beverage dispenser, the first, second, and third conduits would be tubular portions of a continuous tubular coil for the carbonated water. This tubular coil would be imbedded in the cold plate casting, together with the sweet water line and various flavored syrup lines.

With this arrangement, the carbonated water is precooled as it passes through the second conduit, away from the ice bearing surface of the cold plate. Accordingly, the warm carbonated water is not immediately adjacent the surface and the cavitation problem is greatly reduced. Also, with the longer length of coil that results from utilization of the multiple layers, the cooling efficiency is greater than that realized by use of a single layer coil. By connecting the end of the second conduit at which the carbonated water has already been precooled to the end of the first conduit away from the outlet, the heat transfer from the second conduit to the outlet of the first conduit is considerably reduced from prior art attempts to utilize multiple layers of conduit.

Accordingly, a much more efficient heat exchange cold plate is provided than has been realized with the prior art cold plates. In addition, by greatly minimizing the cavitation problem, the overall efficiency of the heat exchange process is increased even more.

These and other objects, advantages and features of this invention will hereinafter appear, and for purposes of illustration, but not of limitation, an exemplary embodiment of the claimed invention is shown in the appended drawing.

DETAILED DESCRIPTION OF THE PREFERRED EMBODIMENT

Figure 1:
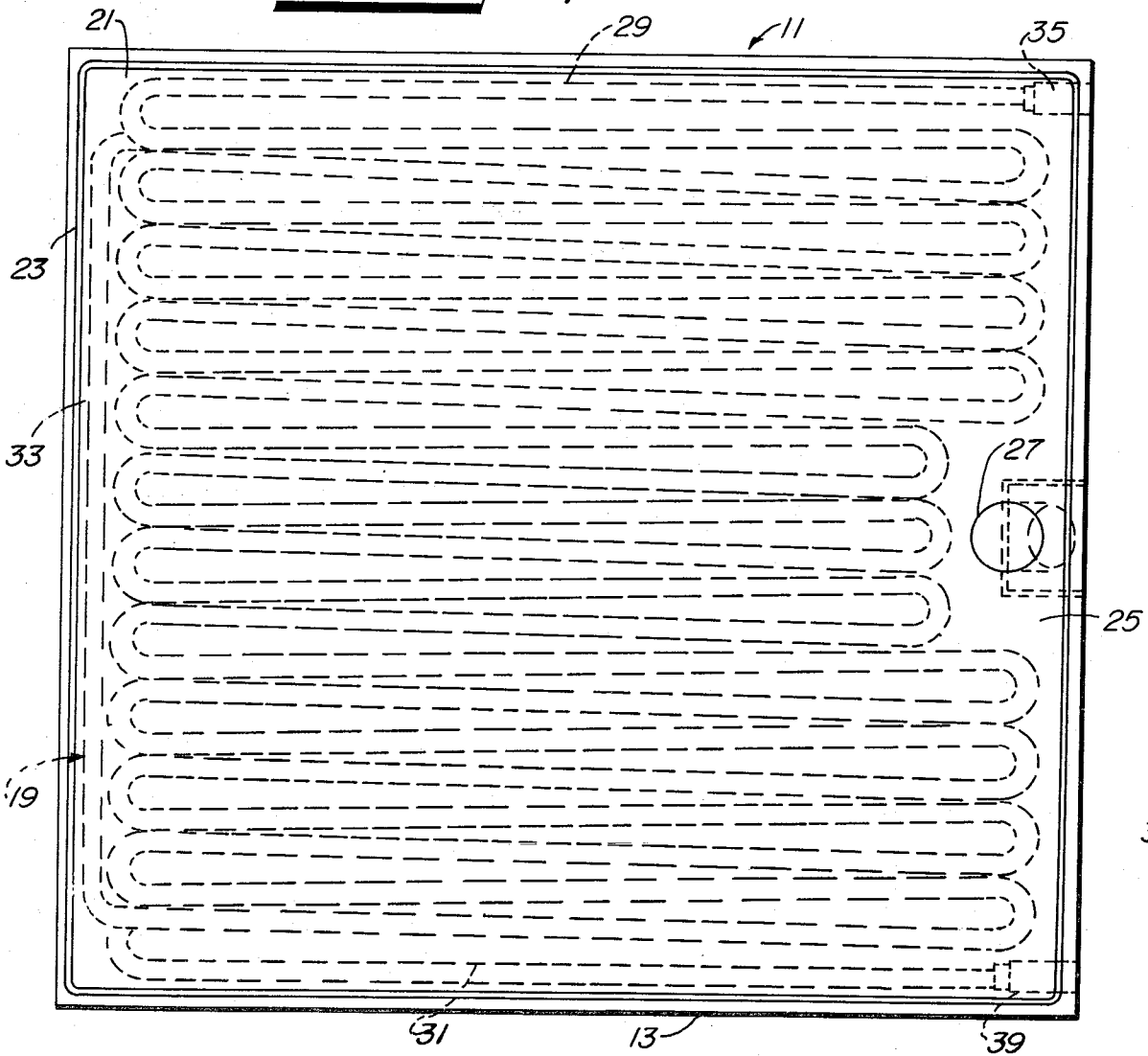
FIG. 1 is a top plan view of a preferred embodiment of a cold plate heat exchanger constructed in accordance with the present invention.

In FIG. 1 there is depicted a cold plate heat exchanger 11 incorporating a preferred embodiment of the present invention. Cold plate 11 has a casting 13 in which are embedded lines 15 for a variety of flavored syrups, a sweet water line 17 and a carbonated water coil 19. Casting 13 may be made of any suitable heat conducting material, such as aluminum, which provides a rigid supporting structure. Similarly, the lines 15 and 17 and the coil 19 may be formed of any suitable material, such as stainless steel.

Figure 2:
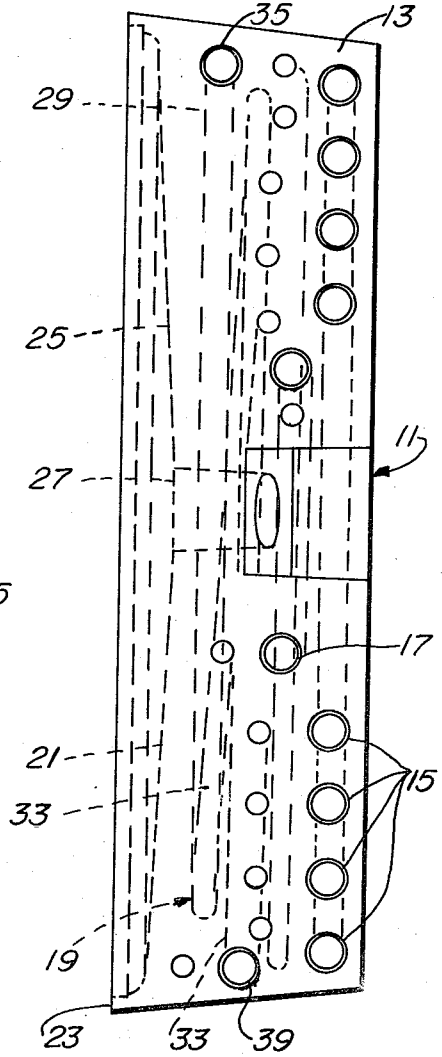
FIG. 2 is a front elevational of the cold plate heat exchanger of FIG. 1.

A depression 21 is formed in the top of casting 13. Depression 21 forms the major portion of the top of casting 13, except for a rim 23. Ice to cool the components of cold plate 11 is placed in the depression 21 and extends upwardly from the cold plate 11 and is held in position on top thereof by a suitable frame, such as a plastic shield or guard (not shown). The bottom surface of depression 21 may be regarded as generally planar, although as best seen in FIG. 2 it is formed with some slope toward a drain 27. Drain 27 provides for removal of the melt water from the ice that collects in depression 21. Incidentally, the ice may be in any appropriate form, such as chips or cubes, that provides a high surface area for good heat absorption.

Heat transfer from the casting to the ice occurs through the bottom surface 25 of depression 21. Accordingly, the bottom of depression 21 may be designated the heat exchange surface. While this heat exchange surface is shown as being utilized for cooling in connection with a beverage dispensing cold plate, many suitable heat transfer functions could be achieved, whether it involves extracting heat from the fluid in coil 19 or adding heat to the fluid in coil 19, by utilizing an appropriate heat source or heat sink on the side of surface 25 away from coil 19.

Figure 4:
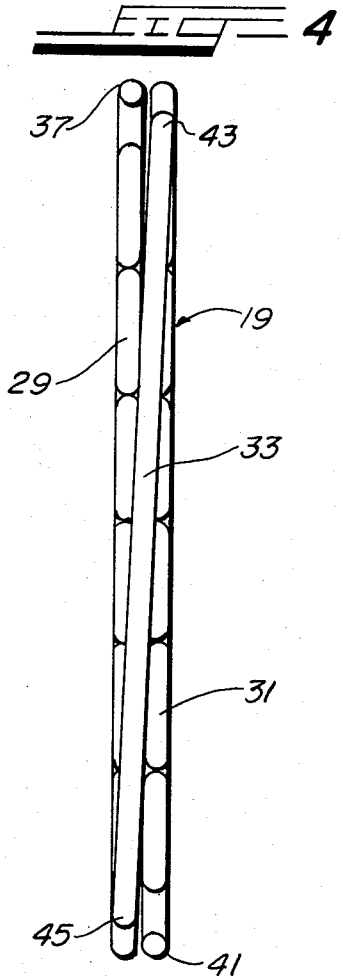
FIG. 4 is a front elevational view of the conduit of FIG. 3.
Figure 3:
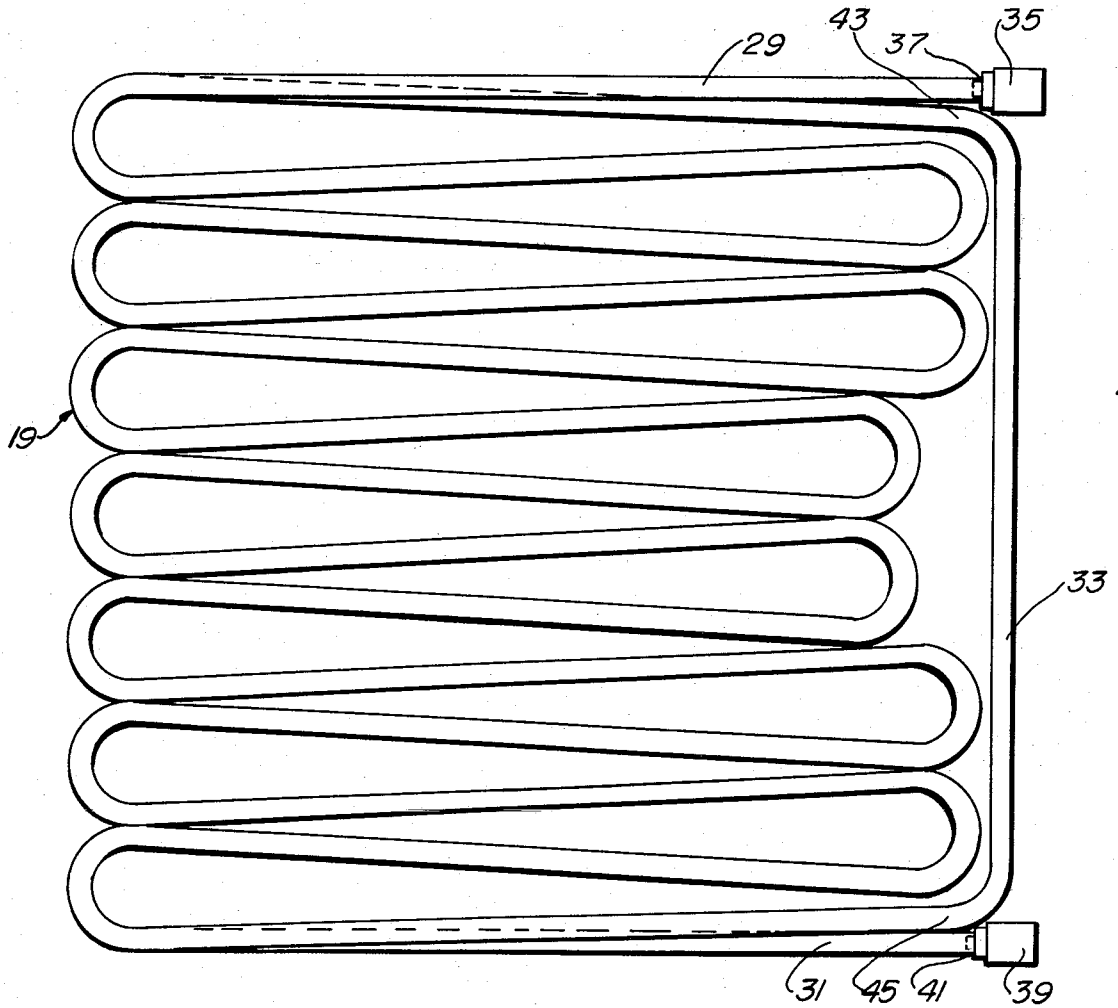
FIG. 3 is a top plan view of the fluid or carbonated water conduit constructed in accordance with the preferred embodiment of FIG. 1.

Details of the preferred embodiment of the coil 19 in this heat exchange arrangement may be best understood by considering FIGS. 3 and 4 in conjunction with FIGS. 1 and 2. It should be noted that while the conduit 19 has been illustrated as a tubular coil, it could have any appropriate shape. In addition, while this preferred embodiment deals with the utilization of the coil 19 in connection with the conveyance of carbonated water for a beverage dispenser, any suitable fluid could be utilized for any purpose.

Coil 19 actually includes three separate parts, a first conduit or tubular member or portion 29, a second conduit or tubular member or portion 31, and a third conduit or tubular member or portion 33. While these segments could be separately joined parts, the preferred approach is to use a single continuous coil 19 as illustrated.

Tubular member 29 lies substantially in a plane (i.e., the central axis of the tube is substantially planar) and has a convoluted or serpentine shape as best seen in FIG. 3. Tubular member 29 is positioned in the upper part of casting 13 as close as practicable to the surface 25. The convoluted shape is utilized for increasing the heat transfer efficiency by exposing as much surface area of tubular member 29 to the heat exchange surface 25 as possible.

Similarly, tubular member 31 also has a convoluted or serpentine shape and lies substantially in a plane that is generally parallel to the heat transfer surface 25. Tubular member or portion 31 is located on the side of tubular member 29 away from the heat transfer surface 25.

An outlet fitting 35 is located at one end 37 of the tubular member or portion 29. Similarly, an inlet fitting 39 is located at one end 41 of tubular member 31. The other end 43 of tubular portion 31 is connected to end 45 of tubular portion 29 by the third tubular portion 33.

With this arrangement, the carbonated water or other fluid inserted into the inlet end 41 of tubular member 31 is conveyed through casting 13 and precooled by the time that it reaches end 43 of tubular portion 31. This precooled carbonated water is then conveyed back to end 45 of tubular portion 29, which is adjacent to the inlet end 41 of tubular portion 31. The carbonated water is then passed back through the casting in even closer proximity to the heat exchange surface 25 for ultimate dispensing through the outlet end 37 of tubular portion 29.

It should be understood that various modifications, changes and variations may be made in the arrangement, operation and details of construction of the elements disclosed herein without departing from the spirit and scope of this invention.

I claim:

1. A cold plate heat exchanger for use in a beverage dispenser comprising:

a generally planar heat conducting surface having a layer of ice on one side thereof to extract heat from the beverage components;

a first tubular member to convey a liquid and positioned along the other side of said heat conducting surface, said first tubular member having first and second ends and coiled in a serpentine shape with the central axis thereof lying substantially in a plane generally parallel to said heat conducting surface to provide a large area of said first tubular member adjacent said heat conducting surface;

an outlet fitting located on said first end of said first tubular member to connect the heat exchanger for conveying the cooled liquid to a dispensing location;

a second tubular member to convey the liquid and positioned along said first tubular member on the side away from said heat conducting surface, said second tubular member having first and second ends and coiled in a serpentine shape with the central axis thereof lying substantially in a plane generally parallel to said heat conducting surface to provide a relatively large area of said second tubular member adjacent said first tubular member;

an inlet fitting located on said first end of said second tubular member, said first end of said second tubular member being adjacent said second end of said first tubular member; and a third tubular member interconnecting said second end of said first tubular member and said second end of said second tubular member.

2. A cold plate heat exchanger as claimed in claim 1 wherein said first, second and third tubular members are a single continuous coil of tubing.

3. A cold plate heat exchanger as claimed in claim 2 wherein:

said coil of tubing is encased in a heat conducting casting with sweet water and flavored syrup conveying lines; and said heat conducting surface is the top of said heat conducting casting.

4. A cold plate heat exchanger as claimed in claim 1 wherein the liquid is carbonated water.

5. A cold plate heat exchanger for use in a beverage dispenser comprising:

a heat conducting casting having a generally rectangular shape;

a depression formed in the top of said casting, said depression covering most of the top of said casting but for an outer rim and the bottom of said depression defining the top surface of the cold plate heat exchanger, said depression collecting the melt water from ice located in and above said depression;

a drain extending from said depression out through said casting;

a plurality of flavored syrup coils embedded in said casting;

a sweet water coil embedded in said casting;

a carbonated water coil embedded in said casting, said carbonated water coil comprising first, second and third tubular portions, said first and second tubular portions each having first and second ends;

an outlet fitting located on said first end of said first tubular portion of said carbonated water coil to provide for conveying cooled carbonated water to a dispensing location, said first tubular portion having a serpentine shape formed substantially in a plane generally parallel to the bottom of said depression, said first tubular portion being positioned immediately adjacent the bottom of said depression; and an inlet fitting located on said first end of said second tubular portion of said carbonated water coil to provide for the insertion of carbonated water to be cooled, said first end of said second tubular portion being adjacent said second end of said first tubular portion, said second tubular portion having a serpentine shape formed substantially on a plane generally parallel to the bottom of said depression, said second tubular portion being positioned adjacent the side of said first tubular portion away from the bottom of said depression, said third tubular portion interconnecting said second end of said first tubular portion and said second end of said first tubular portion.

6. A cold plate heat exchanger as claimed in claim 5 wherein:

said casting is formed primarily of aluminum; and said flavored syrup, sweet water and carbonated water coils are formed of stainless steel.

7. A heat exchanger for fluids comprising:

a generally planar heat exchange surface through which heat transfer is effected;

a first conduit to convey the fluid and positioned along one side of said heat exchange surface, said first conduit having first and second ends and formed in a convoluted shape with the central axis thereof lying substantially in a plane generally parallel to said heat exchange surface to produce a large area of said first conduit adjacent to said heat exchange surface;

an outlet located at said first end of said first conduit;

a second conduit to convey the fluid and positioned along said first conduit on the side away from said heat exchange surface, said second conduit having first and second ends and formed in a convoluted shape with the central axis thereof lying substantially in a plane generally parallel to said heat exchange surface to provide a large area of said second conduit adjacent said first conduit;

an inlet formed at said first end of said second conduit, said first end of said second conduit being adjacent said second end of said first conduit; and a third conduit interconnecting said second end of said first conduit and said second end of said second conduit.

8. A heat exchanger for fluids as claimed in claim 7 wherein the fluid is a liquid.

9. A heat exchanger for fluids as claimed in claim 8 wherein the liquid is carbonated water.

10. A heat exchanger as claimed in claim 7 wherein said first, second and third conduits are unitarily formed tubes to provide a continuous tubular coil for the fluid.

11. A heat exchanger for fluids as claimed in claim 10 wherein:

said tubular coil is embedded in a casting; and said heat exchange surface is the top surface of said casting.

12. A heat exchanger for fluids as claimed in claim 11 wherein ice is located on top of said casting to extract heat from the fluid in said tubular coil.

13. A heat exchanger for fluids as claimed in claim 7 wherein said convoluted shape is a serpentine arrangement.

* * * * *